US006513425B1

(12) United States Patent
Brox

(10) Patent No.: US 6,513,425 B1
(45) Date of Patent: Feb. 4, 2003

(54) ASSEMBLY FOR POSITIONING A HEATER IN A RELATION TO A ROLL, AND A PRESS DEVICE WITH SUCH AN ASSEMBLY

(75) Inventor: Erik Brox, Forshaga (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/566,246

(22) Filed: May 5, 2000

Related U.S. Application Data

(60) Provisional application No. 60/133,590, filed on May 11, 1999.

(30) Foreign Application Priority Data

May 5, 1999 (SE) ..... 9901614

(51) Int. Cl.[7] ..... B30B 15/34
(52) U.S. Cl. ..... 100/329; 100/332; 162/358.5
(58) Field of Search ..... 100/329, 332, 100/153; 162/358.5; 165/89

(56) References Cited

U.S. PATENT DOCUMENTS 4,653,395 A * 3/1987 Verkasalo ..... 100/332
4,675,487 A * 6/1987 Verkasalo ..... 100/327
4,705,711 A * 11/1987 Perna ..... 29/DIG. 23
4,948,466 A * 8/1990 Jaakkola ..... 100/38
5,076,891 A * 12/1991 Link et al. ..... 100/328
5,092,962 A * 3/1992 Koski ..... 100/332
5,223,099 A * 6/1993 Salo ..... 100/330
5,556,511 A * 9/1996 Bluhm et al. ..... 162/111
5,711,854 A * 1/1998 Schiel et al. ..... 100/176
5,749,158 A * 5/1998 Muller et al. ..... 34/119
5,810,974 A * 9/1998 Laapotti ..... 162/206
6,031,215 A * 2/2000 Nanataki et al. ..... 219/619
6,332,955 B1 * 12/2001 Meschenmoser ..... 162/358.3

* cited by examiner

*Primary Examiner*—Rinaldi I. Rada
*Assistant Examiner*—Louis Tran
(74) *Attorney, Agent, or Firm*—Alston & Bird LLP

(57) ABSTRACT

The invention relates to an assembly for positioning a heater in relation to a roll, wherein the roll (101) has a substantially cylindrical shape with a shall surface (103), rotatable around a shell axis (102), at a first distance (104) from the shell axis (102). The heater (105) comprises at least one heater section (106, 106', 106") intended for heating the shell surface (103), and is supported via a suspension attachment (107) by means of a supporting means (108) on a variable, second distance (109) from the shell axis (102). Thereby, the heater section (106, 106', 106") is furnished with at least one distance control means (110, 110') arranged for being in contact with the shell surface (103) during the heating and for automatically regulating the second distance (109) by means of a self-regulating mechanism. The invention further relates to a press device with such an assembly, and is particularly advantageously implemented in connection with impulse pressing of paper webs in so called shoe presses having an extended nip, but can also be implemented for other types of heated rolls in a paper machine.

26 Claims, 6 Drawing Sheets

ASSEMBLY FOR POSITIONING A HEATER IN A RELATION TO A ROLL, AND A PRESS DEVICE WITH SUCH AN ASSEMBLY

CROSS-REFERENCE TO RELATED APPLICATION

This application claims the benefit of U.S. Provisional Patent Application Ser. No. 60/133,590 filed May 11, 1999 and Swedish Appl. No. 9901614-9 filed May 5, 1999

TECHNICAL FIELD

The present invention relates to an assembly for positioning a heater in relation to a roll. The invention further relates to a press device with such an assembly.

The invention is particularly advantageously implemented in connection with impulse pressing of fibre webs in a so called shoe presses having an extended nip, but can also be implemented when positioning heaters in connection with other types of heated rolls in a paper machine.

BACKGROUND OF THE INVENTION

In connection with the manufacture of wet formed fibre webs, for example paper webs, usually some kind of press device is used in order to increase the dry content of the fibre web by means of a mechanical dewatering before a subsequent drying process. The reason why pressing advantageously is utilised instead of drying is that it is more energy efficient, and that the pressing often plays an important role for the physical properties of the finished paper sheet or fibre material.

One of the more simple previously known types of press devices consists of two rotatable press rolls which can be brought into pressing contact with each other in order to form a nip through which the web fibre web is guided. Thereby, the wet fibre web is usually guided through the nip supported on a press felt, or between two press felts or press fabrics.

When for example the maximum achievable dryness increase of a web fibre web is concerned, also press devices having an extended nip have been developed in order to further increase the efficiency of the pressing. Press devices having an extended nip have also proved to provide greater possibilities of influencing, or of avoiding a too large influence, on the physical properties of the finished paper sheet of fibre material.

The evolution of the dewatering technique has also resulted in so called impulse technique, usually referred to as impulse pressing or impulse drying, which in principle implies that the pressing takes place at a strongly increased temperature. Trials have proved that even higher dry contents can be achieved after the pressing by means of utilising press devices which are based on impulse technique. Furthermore, the impulse technique has proved to provide further possibilities to influence the physical properties of the finished paper sheet or fibre material.

Press devices utilising a combination of an extended nip and impulse technique are also previously known. Accordingly, for example the patent publication U.S. Pat. No. 4,738,752 discloses an apparatus for removing fluid from a fibrous web. The disclosed apparatus is claimed to comprise a press member and a blanket cooperating with the press member for defining therebetween an elongated pressing section in such a way that the web is pressed between the press member and the blanket during the passage through the pressing section. The apparatus further comprises a concave press shoe for urging said blanket towards said press member so that fluid is pressed out from the web when the web passes through the pressing section.

The apparatus disclosed in U.S. Pat. No. 4,738,752 further comprises a heating means adjacent to the press member for transferring heat to the web, whereby the web is subjected for an extended period to increased pressure and increased temperature when it passes through the pressing section, so that the water vapour which is generated within the pressing section during the passage forces the fluid away from the web. The apparatus further comprises a thermal transfer means cooperating with the blanket for defining the pressing section therebetween, wherein the transfer means transfers heat from the heating means to the web during the passage of the web through the pressing section. Finally, the apparatus comprises a further blanket between the thermal transfer means and a convex surface defined by the press member, so that the blanket, the web, the thermal transfer means and the further blanket move together between the convex surface and a cooperating concave surface defined by said concave press shoe for removing fluid from the web.

According to U.S. Pat. No. 4,738,752, the convex surface can be provided by a rotatable press roll, wherein the heating means can be arranged adjacently to the rotatable press roll for heating it, resulting in a subsequent heating of the web which is to be pressed. The heating means can be of a number of different types, such as an induction heater, an infrared heater, a microwave heater, a burner, a resistance heater, a laser heater or the like.

However, it has been found that heating of for example a press roll of the above-mentioned type by means of an external heater can be associated with certain problems. When heating a shell of a roll, an uneven temperature profile may occur in the shell in the axial direction of the roll, i.e. transversely to the machine direction. Possible reasons for such an uneven temperature profile are, for example, that the distance from the heater to the shell surface varies in different positions along the axial direction of the roll, or that the fibre web is drier or more wet in streaks in different positions along the cross direction of the web after the forming. Because of the intrinsic thermal expansion properties of the roll shell, the roll shell will exhibit a larger thermal expansion in its radial direction in connection with streaks having a higher temperature, and a smaller thermal expansion in connection with streaks having a lower temperature. The larger thermal expansion in the radial direction in connection with streaks having a higher temperature will in turn bring the shell surface closer to the heater so that the temperature of the shell surface in the streak in question is increased even further, which in turn results in an even larger radial thermal expansion with a resulting local temperature increase, and so on. This "vicious circle" results in a fibre web which is unevenly dewatered/dried in the cross direction, and in the roll shell being subjected to very large thermal and mechanical stresses.

SUMMARY OF THE INVENTION

Therefore, the first object of the present invention is to provide an assembly for positioning a heater in relation to a roll, which eliminates the risk of a "vicious circle" of the above-mentioned kind being created.

In accordance with one preferred embodiment of the invention, the first object is achieved by means of a roll of the assembly having a substantially cylindrical shape with a shell surface, rotatable around a shell axis, at a first distance from the shell axis, the heater comprising at least one heater section intended for heating the shell surface, and the heater section being supported, via a suspension attachment, by a supporting means at a variable, second distance from the shell axis. Thereby, according to the invention, the heater section is provided with at least one distance control means arranged for being in contact with the shell surface during the heating and for automatically regulating the second distance by means of a self-regulating mechanism.

A second object of the present invention is to provide a press device, intended for pressing a fibre web in a nip, which utilises the assembly according to the invention.

In accordance with another embodiment of the invention, this second object is achieved by means of the press device comprising at least one roll having a substantially cylindrical shape with a shell surface rotatably arranged around a shell axis, and at least one heater intended to heat the shell surface before the nip during the pressing, wherein at least one assembly according to the invention is arranged for positioning the heater in relation to the roll during the pressing.

Further objects of the present invention will become evident from the following description, while the features enabling the further objects to be achieved are listed in the attached, dependent claims.

BRIEF DESCRIPTION OF THE DRAWINGS

In the following, the invention will be described in greater detail with reference to be attached drawings, in which.

DETAILED DESCRIPTION OF PREFERRED EMBODIMENTS

Figure 1:
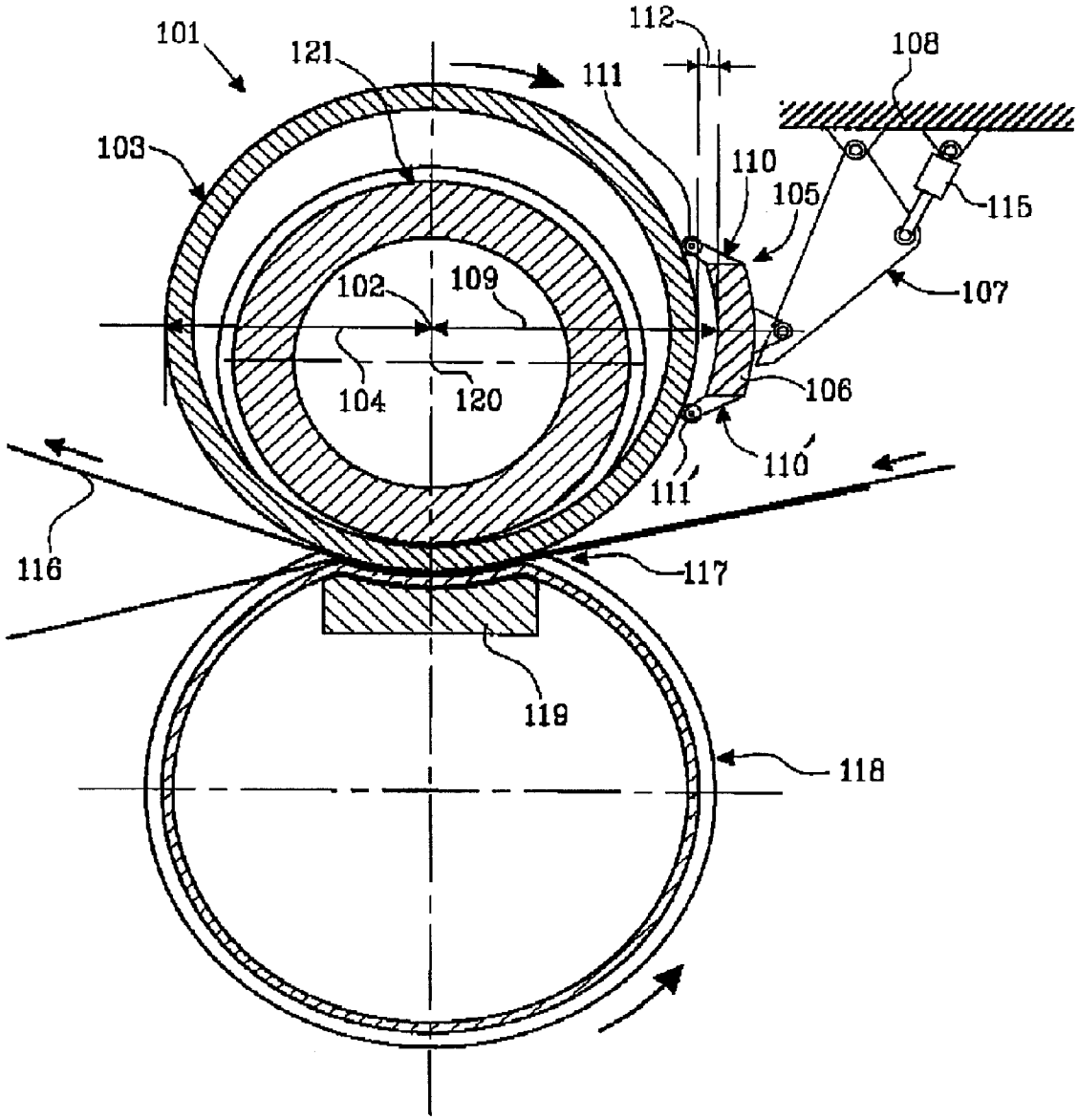
FIG. 1 shows a schematic sectional view through an assembly according to a preferred embodiment of the invention arranged in relation to a roll of a press device having an extended nip which utilises impulse technique.

In the following, an assembly according to the invention for positioning a heater in relation to a roll will be described in greater detail with reference to the attached FIGS. 1–6.

The assembly has a roll 101; 201; 301; 401, having an substantially cylindrical shape with a shell surface 103; 203; 303; 403 which is rotatable around the shell axis 102; 202; 302; 402 at a first distance 104; 204; 304; 404 from the shell axis 102; 202; 302; 402. The heater 105; 205; 305; 405 comprises at least one heater section 106, 106', 106"; 206, 206'; 306; 406 intended for heating the shell surface 103; 203; 303; 403, wherein the heater section 106, 106', 106"; 206, 206'; 306; 406, via a suspension attachment 107; 207; 307; 407, is supported by a supporting means 108; 208; 308; 408 at a variable, second distance 109; 209; 309; 409 from the shell axis 102; 202; 302; 402. According to the invention, the heater section 106, 106'; 106"; 206, 206'; 306; 406 is provided with at least one distance control means 110, 110'; 210, 210'; 310; 410, 410' arranged for being in contact with the shell surface 103; 203; 303; 403 during the heating and for automatically regulating the second distance 109; 209; 309; 409 by means of a self-regulating mechanism. In this way, the assembly according to the invention eliminates the above-mentioned problem with streaks with a higher temperature bringing the shell surface closer to the heater so that the temperature of the shell surface is increased even more. Thereby, the roll and the heater can be of any suitable type, and be intended for any application in which problems with an uneven temperature profile may occur. Also the suspension attachment and the supporting means can be of previously known, suitable types.

In an advantageous embodiment of the assembly according to the invention, the heater 105; 205; 305; 405 comprises a plurality of said heater sections 106, 106', 106"; 206, 206' arranged in the direction of the shell axis 102; 202; 302; 402 along the shell surface 103; 203; 303; 403. Thereby, the heater sections 106, 106', 106"; 206, 206' are displaceably arranged in relation to each other in substantially the direction of the second distance 109; 209; 309; 409, so that an individual regulation of the second distance for each heater section is enabled. Thereby, the number of heater sections can vary, depending on the axial length of the roll, and for example be two in the case of a roll having a small axial length and ten or more in the case of a roll having a large axial length.

In the described advantageous embodiment, the shell surface 103; 203; 303; 403 exhibits different shell zones 103*a*, 103*b*; 203*a*, 203*b* along the shell axis 102; 202; 302; 402, which zones may come to exhibits a larger or smaller first distance 104; 204; 304; 404 and/or a lower or higher temperature during heating. Thereby, each of the shell zones exhibits a third distance 112; 212; 312; 412 between the shell surface 103; 203; 303; 403 and the heater section 106, 106', 106"; 206, 206'; 306; 406 in question, wherein the self-regulating mechanism is arranged such that the distance control means 110, 110'; 210, 210'; 310; 410, 410' stands in contact with the shell surface 103; 203; 303; 403 via one or several contact members 111, 111'; 211, 211'; 311; 411, 411', 411" during the heating. According to this embodiment, the suspension attachment 107; 207; 307; 407 is arranged for displacing the heater section 106; 206; 306; 406 in a direction towards the shell axis 102; 202; 302; 402 in case of the smaller first distance and/or the lower temperature, and for allowing the heater section 106"; 206'; 306; 406 in question to be displaced in a direction from the shell axis 102; 202; 302; 402 in case of the larger first distance and/or the higher temperature. Thereby, the contact with the shell surface can be physical contact, thermal contact, electrical contact, pneumatic or hydraulic contact, or a combination of these.

Figure 2:
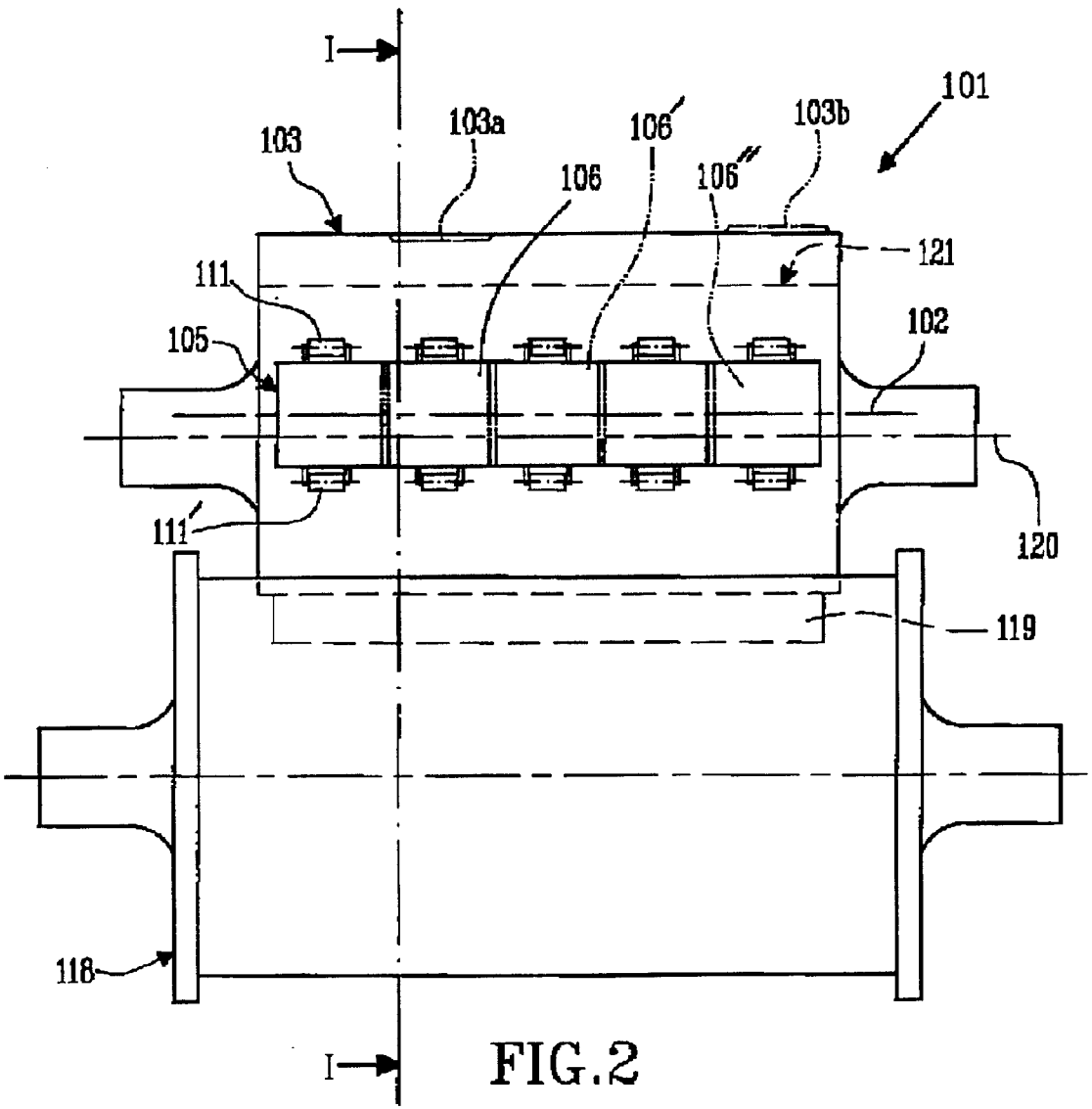
FIG. 2 shows a schematic view of the assembly on FIG. 1, seen from the wet end of the press device.
Figure 6:
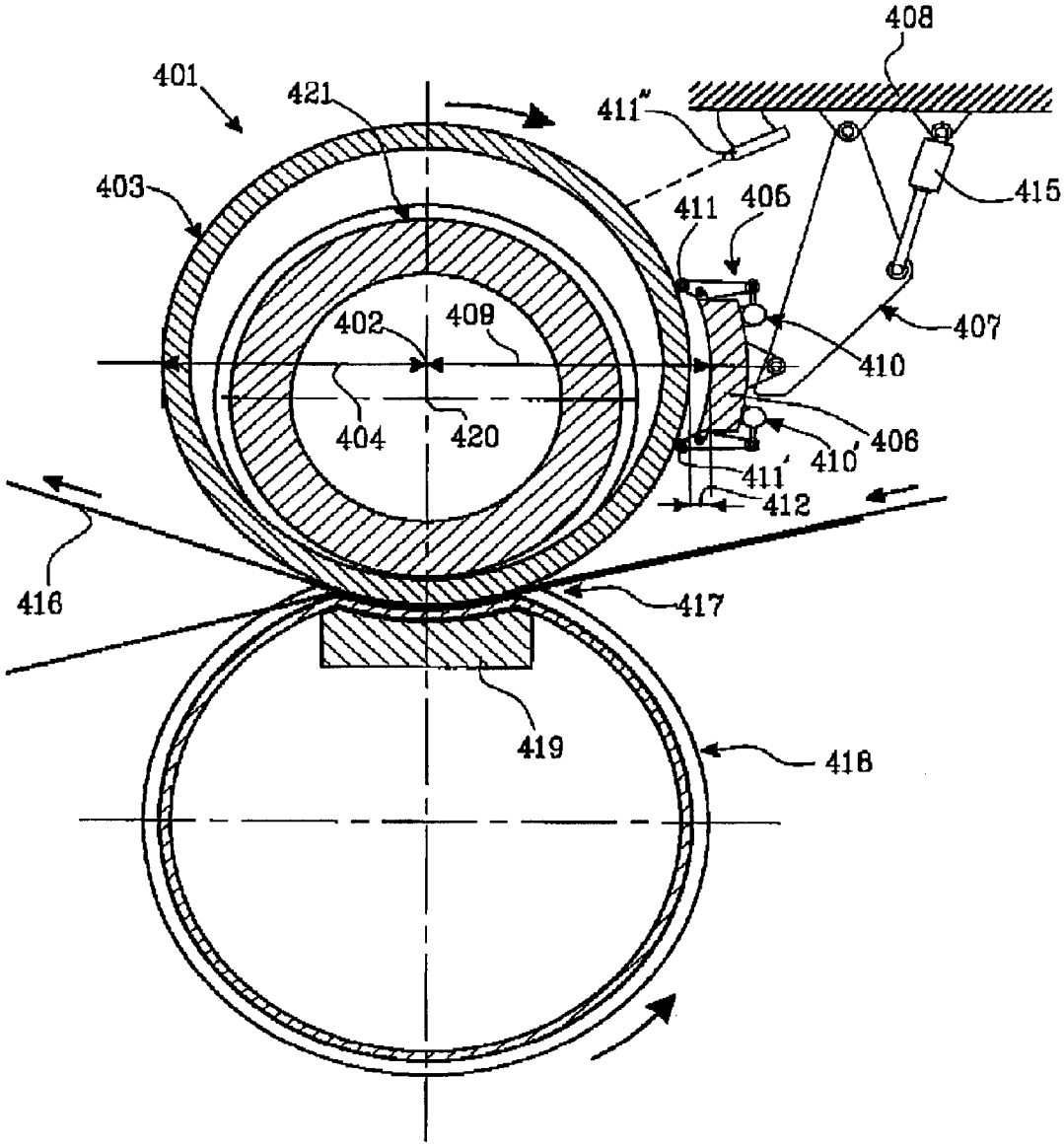
FIG. 6 shows a schematic sectional view through a portion of an assembly according to a second alternative embodiment of the invention.

According to a first, preferred embodiment of the invention, shown in FIGS. 1 and 2 and also partially illustrated by FIG. 6, the contact member or members 111, 111'; 411, 411' is/are arranged for being in physical contact with the shell surface 103; 403 during the heating and for maintaining the third distance 112; 412 substantially constant along the shell surface 103; 403 in the direction of the shell axis 102; 402 in cooperation with the suspension attachment 107; 407. In this way, the above-mentioned problem with streaks having a higher temperature bringing the shell surface closer to the heater so that the temperature of the shell surface is increased even further, is eliminated in a simple, reliable and cost efficient way.

Figure 3:
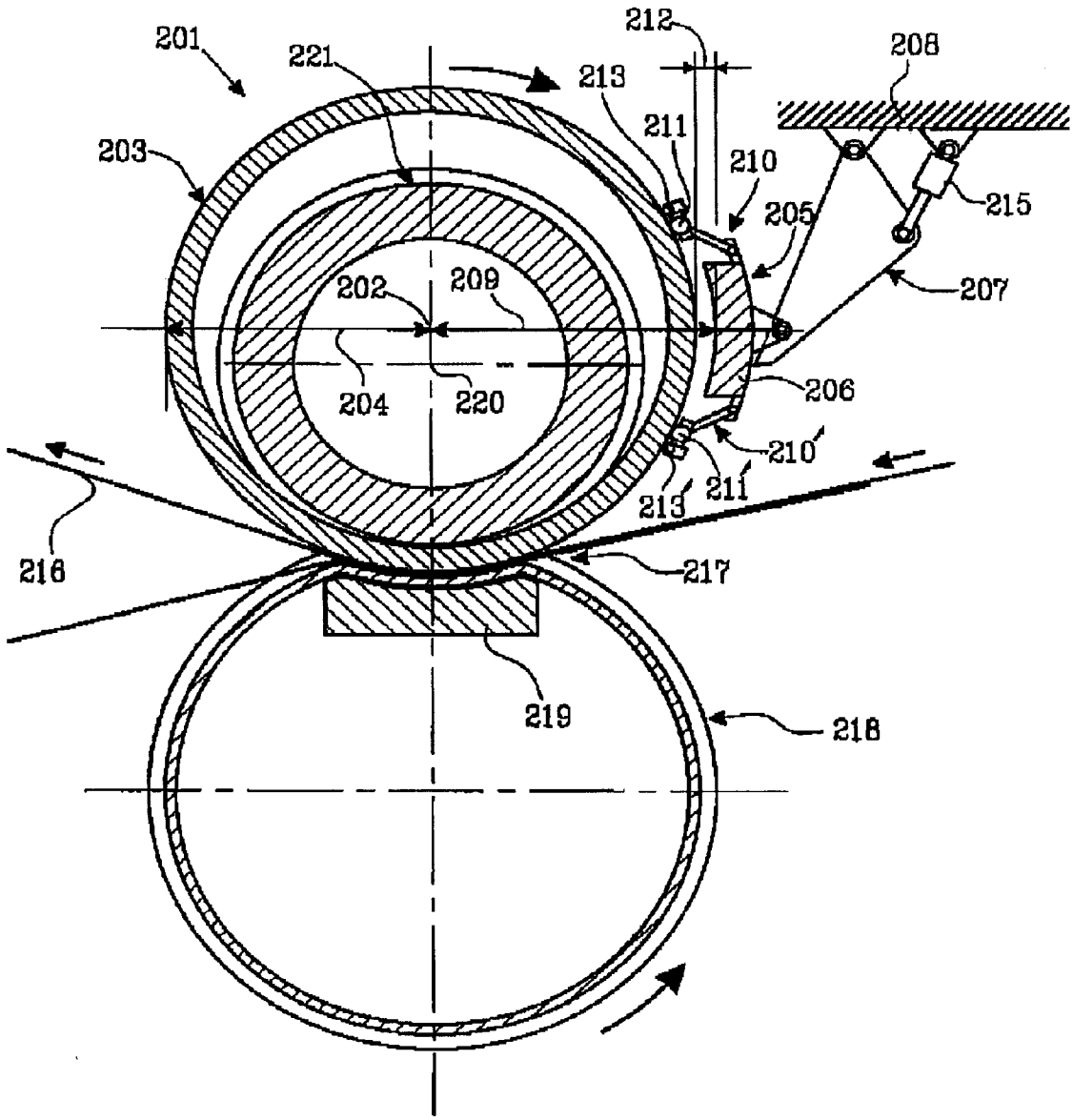
FIG. 3 shows a schematic sectional view through an assembly according to a particularly preferred embodiment of the invention arranged in relation to a roll of a press device having an extended nip utilising impulse technique.
Figure 4:
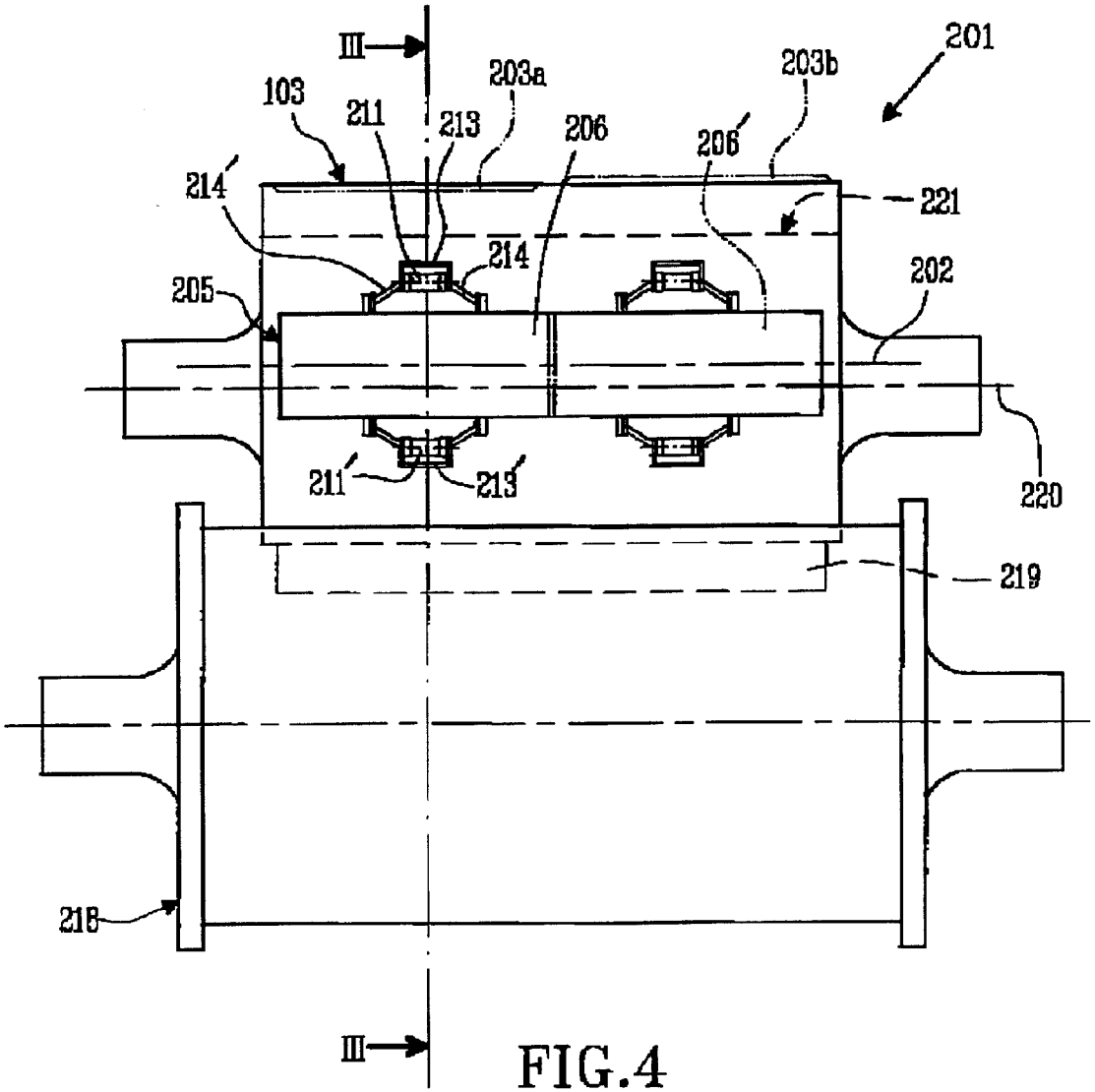
FIG. 4 shows a schematic view of the assembly in FIG. 3, seen from the wet the end of the press device.

According to a particularly preferred embodiment of the invention, shown in FIGS. 3 and 4, the contact member of members 211, 211' is/are arranged for receiving heat from the shell surface 203 during the heating and for transferring the heat to at least one heat expandable member 213, 213', which in cooperation with the distance control means 210, 210' and the suspension attachment 207 causes the third distance 212 to become larger at a higher temperature and smaller at a lower temperature of the shell surface 203. In this embodiment, the contact member or members may receive heat through heat conduction, convection or heat radiation, and transfer the heat directly to the heat expandable member(s).

In addition to eliminating the above-mentioned problem with the "vicious circle", the assembly according to the above-described particularly preferred embodiment provides a number of additional advantages. The assembly according to this embodiment, namely, also provides an automatic regulation of the temperature of the shell surface, since the intrinsic thermal expansion properties of the above-mentioned heat expandable member(s) controls the distance between the heater/heater section and the shell surface as a function of, among other things, the temperature of the shell surface, so that the temperature of the shell surface during operation will be affected in a predetermined direction until an equilibrium is achieved. Thereby, the resulting equilibrium can be dependent on, for example, the moisture profile in the cross direction of a fibre web entering the pressing.

In the particularly preferred embodiment, each distance control means 210 advantageously comprises at least two slewing brackets 214, 214' having first and second ends, wherein the first end of the slewing brackets carries the contact member 211 and are connected by at least one of said heat expandable members 213, whereas the second ends of the slewing brackets 214, 214' are flexibly attached to said heater 205 or said suspension attachment 207. In this embodiment, the above-mentioned heat expandable member (s) can constitute a relatively small portion of the distance control means, but still generate a relatively large change of the above-mentioned third distance between the heater/heater section and the shell surface. It is also conceivable with embodiments in which an even larger change of the third distance, in relation to the linear expansion of the heat expandable member, is achieved by means of utilising a lever principle.

The heat expandable member 213 is particularly advantageously constituted of a construction material having a known thermal expansion, which together with the temperature of the shell surface 203 and an adapted geometry between the contact member(s) 211, the heat expandable member 213, and the slewing brackets 214, 214', controls the third distance 212. By means of this embodiment, the interval within which the third distance is controllable can be tailored for the application in question, for example depending on the expected operating temperatures.

In another advantageous embodiment of the assembly according to the invention (not shown in the drawings), the contact member(s) also constitute(s) the heat expandable member. This advantageous embodiment provides significant material savings and a simplified design.

In embodiments in which the assembly comprises one or several heat expandable members 213, 213', this or these particularly advantageously consist(s) of a heat resistant polymer material or an essentially pure metal. To select a heat resistant polymer material of a previously known type per se is particularly advantageous, since a material with the desired linear expansion can be selected. An essentially pure metal, such as copper, aluminium or zink is preferred before a metal alloy, because of its better thermal conductivity and known linear expansion. However, it is also conceivable with embodiments in which other suitable materials having a suitable coefficient of thermal expansion are utilised.

Figure 5:
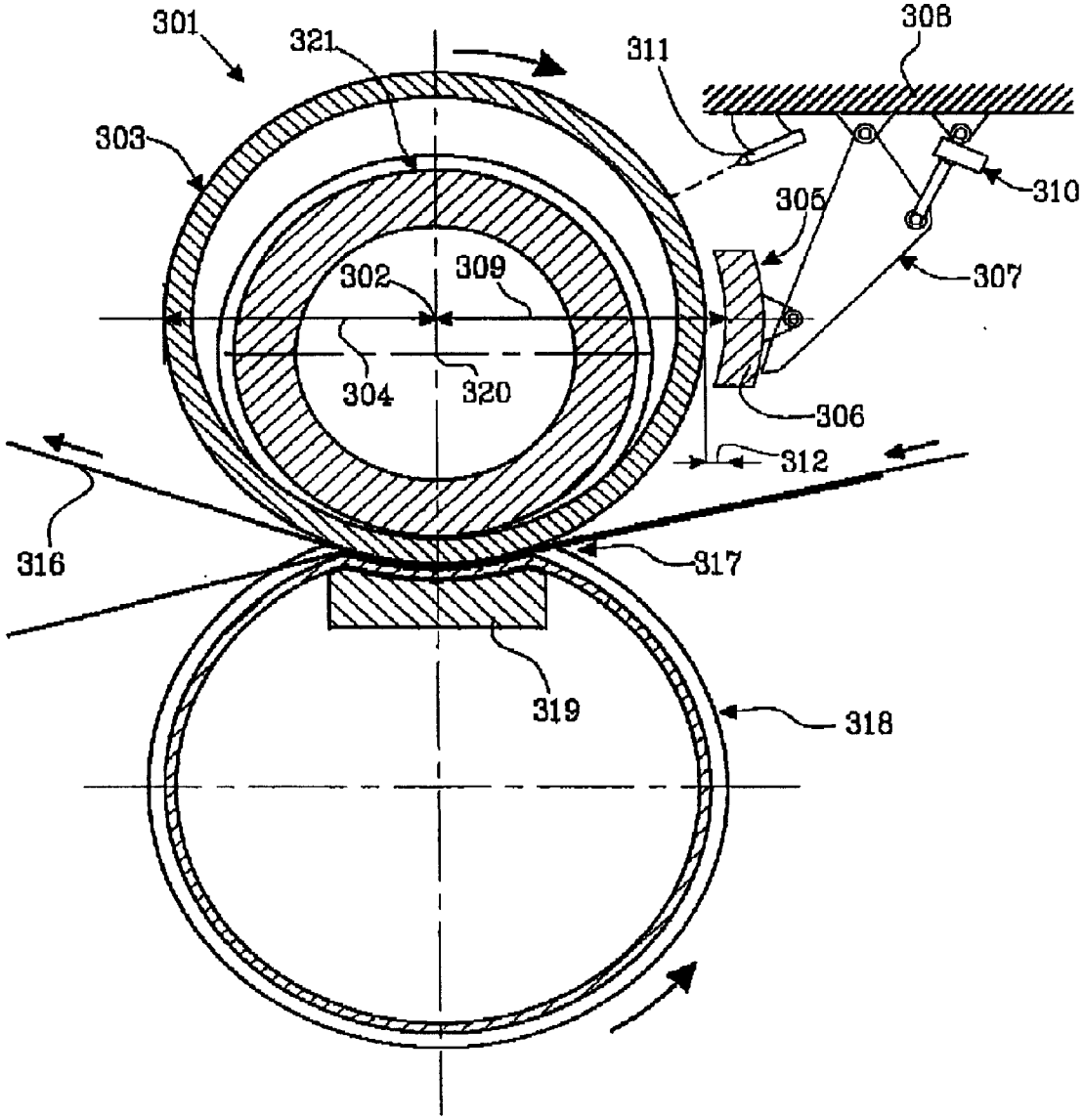
FIG. 5 shows a schematic sectional view through a portion of an assembly according to a first alternative embodiment of the invention.

In two advantageous alternative embodiments of the assembly according to the invention, illustrated in FIGS. 5 and 6, the contact member(s) comprise(s) temperature sensor means 311, 411" arranged for detecting the temperature of the shell surface 303; 403 during the heating and for transferring a signal corresponding to the temperature to a microprocessor (not shown in the drawings). In the two alternative embodiments, the distance control means comprises at least one electric, hydraulic and/or pneumatic actuating means 310; 410, 410' arranged for being controlled by said microprocessor and, in cooperation with the suspension attachment 307; 407, for causing the third distance 312; 412 to become larger at the above-mentioned higher temperature and smaller at the above-mentioned lower temperature of the shell surface 303; 403. Thereby, the actuating means advantageously comprise an electric motor, an electrically controlled hydraulic or pneumatic valve connected to a pressure cylinder, or a combination of these.

In the first alternative embodiment illustrated in FIG. 5, the third distance 312 is regulated solely by the actuating means 310 controlled by the microprocessor (not shown). In the second alternative embodiment illustrated in FIG. 6, the magnitude of the third distance 412 is kept substantially constant by the contact members 411, 411' in physical contact with the shell surface 403, whereas the microprocessor (not shown) controlling the actuating means 415 "fine-tunes" the third distance 412 as a function of the shell surface 403 temperature detected by the temperature sensor means 411". Accordingly, in the two alternative embodiments, the contact between the shell surface 303; 403 and the distance control means 310; 410, 410' entirely or partially is provided by the temperature sensor means 311; 411" via the microprocessor (not shown in the drawings). The above-mentioned microprocessor is advantageously included in a computer with a suitable control software, which preferably is programmed so that the computer, when the temperature of the shell surface exceeds a preselected value, sends a signal to the actuating means inducing an increase of the distance between the heater section and the shell surface, and when the temperature falls below the preselected value, sends a signal inducing a decrease of the distance.

In all embodiments of the assembly according to the invention in which a contact member is intended to physically be in touch with the shell surface during operation, it is particularly advantageous that the contact member 111, 111'; 211, 211'; 411, 411' is constituted of one or several rotatable contact members of a heat resistant material. However, it is also conceivable with other types of contact members, for example skids of a low friction material or brushes of a high temperature resistant material.

In still another advantageous embodiment of the assembly according to the invention, the heater 105; 205; 405 is flexibly attached to the suspension attachment 107; 207; 407, wherein the suspension attachment exercises a spring force on the heater substantially in a direction towards the shell surface 103; 203; 403 during the heating. Thereby, the suspension attachment 107; 207; 407 particularly advantageously comprises a pneumatic cylinder 115; 215; 415 or a spring intended to provide the spring force. This embodiment provides the additional advantage that the heater, for example in case of a web break, can spring out in a direction away from the shell surface and allow fibre clots and the like to pass without risk of the assembly according to the invention being damaged.

In the following, a preferred embodiment of a press device utilising the above described assembly will be described with reference to the attached FIGS. 1–6.

Thereby, the press device is intended for pressing a fibre web 116; 216; 316; 416 in a nip 117; 217; 317; 417. The fibre web can be of any previously known type, for example a paper web or another fibre web, but is advantageously a wet formed paper web with a relatively low dryness.

The press device comprises at least one roll 101; 201; 301; 401 having a substantially cylindrical shape, with a shell surface 103; 203; 303; 403 rotatably arranged around a shell axis 102; 202; 302; 402, and at least one heater 105; 205; 305; 405 intended to heat the shell surface before the nip during the pressing. Thereby, according to the invention and the preferred embodiment, at least one assembly according to the invention of one of the above-described types is arranged for positioning the heater 105; 205; 305; 405 in relation to the roll 101; 201; 301; 401 during the pressing.

In the preferred embodiment, the press device further comprises a second press surface in the form of a flexible belt 118; 218; 318; 418, arranged in an endless loop and intended to create a nip pressure in the nip 117; 217; 317; 417 in movement together with the roll 101; 201; 301; 401 during the pressing. Thereby, according to the preferred embodiment, at least one pressure shoe 119; 219; 319; 419 is arranged within the loop and intended to contribute to the nip pressure during the pressing. Accordingly, the press device is of a previously known type per se, having an extended nip.

In the particularly preferred embodiment of the press device according to the invention, the shell surface 103; 203; 303; 403 encloses a substantially cylindrical press body 121; 221; 321; 421 rotatably arranged around a main axis 120; 220; 320; 420 of the roll 101; 201; 301; 401 in a loose relationship, which enables the shell surface 103; 203; 303; 403 to expand freely in all directions during the heating before the nip 117; 217; 317; 417.

In the preferred embodiment, the shell surface 103; 203; 303; 403 is provided by a rigid, shape permanent sleeve having a circular cross-section, wherein the rigid sleeve has a predetermined, constant or axially varied wall thickness.

The above-mentioned type of press device in which the roll comprises a sleeve (shell surface), constituting a thermal transfer member which encloses the substantially cylindrical press body, is disclosed in the applicant's own Swedish, yet not published, patent application SE 9803201-4. Because of the more uniform temperature profile which is achieved, the assembly according to the invention provides further advantages in addition to the advantages evident from above, such as the tendency of the sleeve (shell surface) to "wander" across the machine direction being minimised when operating press devices of this type. However, the assembly according to the invention can of course also be utilised in connection with other types of press rolls.

The heater 105; 205; 304; 405 included in the press device according to the invention is particularly advantageously a fixed or movable induction heater of a previously known type for impulse pressing. However, it is also conceivable with embodiments in which the heater, for example, is an infrared heater, a microwave heater, a burner, a resistance heater, a laser heater of the like.

The present invention should not been regarded as being limited to what has been described above in connection with the preferred embodiments, or to what is shown in the attached drawings, but the scope of the invention is defined by the attached claims.

Accordingly, the assembly according to the invention can be utilised also for positioning a heater in relation to a heated roll not being part of a press device for a fibre web, but where similar problems occur, for example in connection with in-line coating of paper, or in connection with other heated rolls in paper machines.

What is claimed is:

1. A heater assembly for heating a substantially cylindrical shell of a roll, the shell having a shell axis about which the shell is rotatable with a surface of the shell at a first distance from the shell axis, the first distance being generally constant but susceptible to variation during operation of the roll, the heater assembly comprising:

at least one heater section operable to heat the shell surface;

a suspension attachment supporting the heater section proximate the shell surface at a second distance from the shell axis and being configured to allow the second distance to be varied; and a distance control mechanism coupled with the heater section, the distance control mechanism having a self-regulating mechanism responsive to the shell surface to automatically regulate the second distance so as to regulate a positional relationship between the heater section and the shell surface, wherein the self-regulating mechanism includes at least one contact member that physically contacts the shell surface so as to maintain a third distance between the shell surface and the heater section substantially constant.

2. The heater assembly of claim 1, wherein the at least one heater section comprises a plurality of said heater sections arranged in a row extending parallel to the shell axis, the heater sections being displaceable relative to each other generally in the direction of the second distance such that the positional relationship between each heater section and the shell surface is regulated independently of the other heater sections.

3. The heater assembly of claim 2, wherein the shell surface has a plurality of shell zones along a direction parallel to the shell axis, the shell zones being susceptible to having different first distances and/or different temperatures from one another, wherein the heater sections are arranged such that each heater section generally corresponds in position to one of the shell zones, and wherein the distance control mechanism comprises a plurality of said distance control mechanisms each having said self-regulating mechanism, each heater section being coupled with one of said self-regulating mechanisms, each self-regulating mechanism being responsive to at least one of the temperature and first distance of the shell surface of the respective shell zone to automatically cause the respective heater section to be displaced toward the shell axis when the first distance and/or the temperature of the shell surface decreases and to be displaced away from the shell axis when the first distance and/or the temperature of the shell surface increases.

4. The heater assembly of claim 3, wherein each self-regulating mechanism includes said at least one contact member that physically contacts the shell surface so as to maintain a third distance between the shell surface and the respective heater section substantially constant.

5. The heater assembly of claim 4, wherein each contact member is arranged to receive heat from the shell surface, and further comprising a heat-expandable element in heat-transfer relation with each contact member, each heat-expandable element cooperating with the distance control mechanism and the suspension attachment to cause the third distance of the respective heater section to be increased as the shell surface temperature increases and to be reduced as the shell surface temperature decreases.

6. The heater assembly of claim 5, wherein each distance control mechanism comprises at least two slewing brackets having first and second ends, the first ends of the slewing brackets supporting the at least one contact member and being connected by at least one of the heat-expandable members, the second ends of the slewing brackets being flexibly attached to one of the heater section and the suspension attachment.

7. The heater assembly of claim 6, wherein the heat-expandable member is constructed of a material having a predetermined thermal expansion.

8. The heater assembly of claim 6, wherein the heat-expandable member is constructed of one of heat-resistant polymer material and an essentially pure metal.

9. The heater assembly of claim 5, wherein the heat-expandable member and the contact member comprise one and the same member.

10. The heater assembly of claim 4, wherein the contact members comprise rollers constructed of a heat-resistant material and in rolling engagement with the roll.

11. The heater assembly of claim 1, wherein the heater section is flexibly attached to the suspension attachment, the suspension attachment applying a spring force on the heater section in a direction substantially toward the shell surface.

12. The heater assembly of claim 11, wherein the suspension attachment comprises one of a pneumatic cylinder and a spring for providing the spring force.

13. A press device for pressing a fibrous web, comprising:

at least one roll having a substantially cylindrical shell, the shell having a shell axis about which the shell is rotatable with a surface of the shell at a first distance from the shell axis;

a counter element in pressing engagement with the roll so as to form a nip therebetween through which the web is passed; and a heater assembly comprising:

at least one heater section operable to heat the shell surface;

a suspension attachment supporting the heater section proximate the shell surface at a second distance from the shell axis and being configured to allow the second distance to be varied; and a distance control mechanism coupled with the heater section, the distance control mechanism having a self-regulating mechanism responsive to the shell surface to automatically regulate the second distance so as to regulate a positional relationship between the heater section and the shell surface, wherein the self-regulating mechanism includes at least one contact member that physically contacts the shell surface so as to maintain a third distance between the shell surface and the heater section substantially constant.

14. The press device of claim 13, wherein the counter element comprises at least one pressure shoe and a flexible belt arranged in an endless loop about the pressure shoe.

15. The press device of claim 13, wherein the roll includes a substantially cylindrical pressing body enclosed within the shell, the pressing body being rotatable about a main axis of the roll in a loose relation with respect to the shell so as to permit the shell to expand freely in all directions during heating thereof.

16. The press device of claim 13, wherein the at least one heater section comprises a plurality of said heater sections arranged in a row extending parallel to the shell axis, the heater sections being displaceable relative to each other generally in the direction of the second distance such that the positional relationship between each heater section and the shell surface is regulated independently of the other heater sections.

17. The heater assembly of claim 16, wherein the shell surface has a plurality of shell zones along a direction parallel to the shell axis, the shell zones being susceptible to having different first distances and/or different temperatures from one another, wherein the heater sections are arranged such that each heater section generally corresponds in position to one of the shell zones, and wherein the distance control mechanism comprises a plurality of said distance control mechanisms each having said self-regulating mechanism, each heater section being coupled with one of said self-regulating mechanisms, each self-regulating mechanism being responsive to at least one of the temperature and first distance of the shell surface of the respective shell zone to automatically cause the respective heater section to be displaced toward the shell axis when the first distance and/or the temperature of the shell surface decreases and to be displaced away from the shell axis when the first distance and/or the temperature of the shell surface increases.

18. The heater assembly of claim 17, wherein each self-regulating mechanism includes said at least one contact member that physically contacts the shell surface so as to maintain a third distance between the shell surface and the respective heater section substantially constant.

19. The heater assembly of claim 18, wherein each contact member is arranged to receive heat from the shell surface, and further comprising a heat-expandable element in heat-transfer relation with each contact member, each heat-expandable element cooperating with the distance control mechanism and the suspension attachment to cause the third distance of the respective heater section to be increased as the shell surface temperature increases and to be reduced as the shell surface temperature decreases.

20. The heater assembly of claim 19, wherein each distance control mechanism comprises at least two slewing brackets having first and second ends, the first ends of the slewing brackets supporting the at least one contact member and being connected by at least one of the heat-expandable members, the second ends of the slewing brackets being flexibly attached to one of the heater section and the suspension attachment.

21. The heater assembly of claim 20, wherein the heat-expandable member is constructed of a material having a predetermined thermal expansion.

22. The heater assembly of claim 20, wherein the heat-expandable member is constructed of one of heat-resistant polymer material and an essentially pure metal.

23. The heater assembly of claim 19, wherein the heat-expandable member and the contact member comprise one and the same member.

24. The heater assembly of claim 18, wherein the contact members comprise rollers constructed of a heat-resistant material and in rolling engagement with the roll.

25. The heater assembly of 15, wherein the heater section is flexibly attached to the suspension attachment, the suspension attachment applying a spring force on the heater section in a direction substantially toward the shell surface.

26. The heater assembly for pressing a fibrous web, comprising:

at least one roll having a substantially cylindrical shell, the shell having a shell axis about which the shell is rotatable with a surface of the shell at a first distance from the shell axis, wherein the roll includes a substantially cylindrical pressing body enclosed within the shell, the pressing body being rotatable about a main axis of the roll in a loose relation with respect to the shell so as to permit the shell to expand freely in all directions during heating thereof;

a counter element in pressing engagement with the roll so as to form a nip therebetween through which the web is passed; and a heater assembly comprising:

at least one heater section operable to heat the shell surface;

a suspension attachment supporting the heater section proximate the shell surface at a second distance from the shell axis and being configured to allow the second distance to be varied; and a distance control mechanism coupled with the heater section, the distance control mechanism having a self-regulating mechanism responsive to the shell surface to automatically regulate the second distance so as to regulate a positional relationship between the heater section and the shell surface;

wherein the heater section is flexibly attached to the suspension attachment, the suspension attachment applying a spring force on the heater section in a direction substantially toward the shell surface, and wherein the suspension attachment comprises one of a pneumatic cylinder and a spring for providing the spring force.

* * * * *